US010299988B2

(12) United States Patent
Shin

(10) Patent No.: US 10,299,988 B2
(45) Date of Patent: May 28, 2019

(54) ACUPRESSURE WALKING MACHINE APPLYING PRESSURE TO FOOT REFLEX ZONES

(71) Applicant: Hyun Oh Shin, Namyangju-si (KR)

(72) Inventor: Hyun Oh Shin, Namyangju-si (KR)

( * ) Notice: Subject to any disclaimer, the term of this patent is extended or adjusted under 35 U.S.C. 154(b) by 56 days.

(21) Appl. No.: 15/533,996

(22) PCT Filed: Dec. 8, 2015

(86) PCT No.: PCT/KR2015/013354

§ 371 (c)(1),
(2) Date: Jun. 7, 2017

(87) PCT Pub. No.: WO2016/093583

PCT Pub. Date: Jun. 16, 2016

(65) Prior Publication Data

US 2018/0311106 A1 Nov. 1, 2018

(30) Foreign Application Priority Data

Dec. 8, 2014 (KR) ..... 10-2014-0174724

(51) Int. Cl.

| | |
|---|---|
| ***A61H 15/00*** | (2006.01) |
| ***A61H 39/04*** | (2006.01) |
| ***A63B 22/02*** | (2006.01) |
| ***A63B 23/04*** | (2006.01) |

(52) U.S. Cl.

CPC ..... *A61H 39/04* (2013.01); *A61H 15/00* (2013.01); *A63B 22/02* (2013.01); *A63B 22/0235* (2013.01); *A63B 22/0285* (2013.01); *A63B 23/04* (2013.01); *A61H 2015/0064* (2013.01); *A61H 2201/1284* (2013.01); *A61H 2201/1695* (2013.01); *A61H 2203/0406* (2013.01)

(58) Field of Classification Search

None

See application file for complete search history.

(56) References Cited

U.S. PATENT DOCUMENTS 5,352,166 A * 10/1994 Chang ..... A63B 22/04 482/37
7,976,437 B1 * 7/2011 von Detten ..... A63B 22/0235 482/54
2007/0060451 A1 3/2007 Lucas (Continued)

FOREIGN PATENT DOCUMENTS

CN 101411934 A 4/2009
CN 103170093 A 6/2013

(Continued)

*Primary Examiner* — Joshua Lee
(74) *Attorney, Agent, or Firm* — Maschoff Brennan

(57) ABSTRACT

An acupressure walking machine for applying pressure to foot reflex zones is disclosed. The present invention relates to an acupressure walking machine for applying pressure to foot reflex zones, the walking machine additionally providing an embossing belt, which is made from an elastic material and circulating in a caterpillar form, to the lower side of a running belt circulating in a caterpillar form so as to restrain acupressure stones from rapidly gathering at a curved turning section, such that the uniform dispersion of the acupressure stones is induced, thereby uniformly distributing the acupressure stones placed on the running belt.

5 Claims, 5 Drawing Sheets

(56) References Cited

U.S. PATENT DOCUMENTS

| | | | | |
|---|---|---|---|---|
| 2007/0072743 | A1* | 3/2007 | Severino | A63B 22/0242 482/54 |
| 2008/0009396 | A1* | 1/2008 | von Detten | A63B 22/02 482/54 |
| 2008/0176719 | A1 | 7/2008 | To | |
| 2012/0178591 | A1 | 7/2012 | Remelius | |

FOREIGN PATENT DOCUMENTS

| | | | |
|---|---|---|---|
| JP | 2000-084035 | A | 3/2000 |
| JP | 2004-313711 | A | 11/2004 |
| JP | 2009-161260 | A | 7/2009 |
| KR | 1999-0035082 | U | 9/1999 |
| KR | 20-0339175 | Y1 | 1/2004 |
| KR | 10-0934009 | B1 | 12/2009 |
| KR | 10-1038381 | B1 | 6/2011 |
| KR | 10-1194018 | B1 | 10/2012 |
| KR | 10-1250893 | B1 | 4/2013 |

* cited by examiner

【Fig. 1】
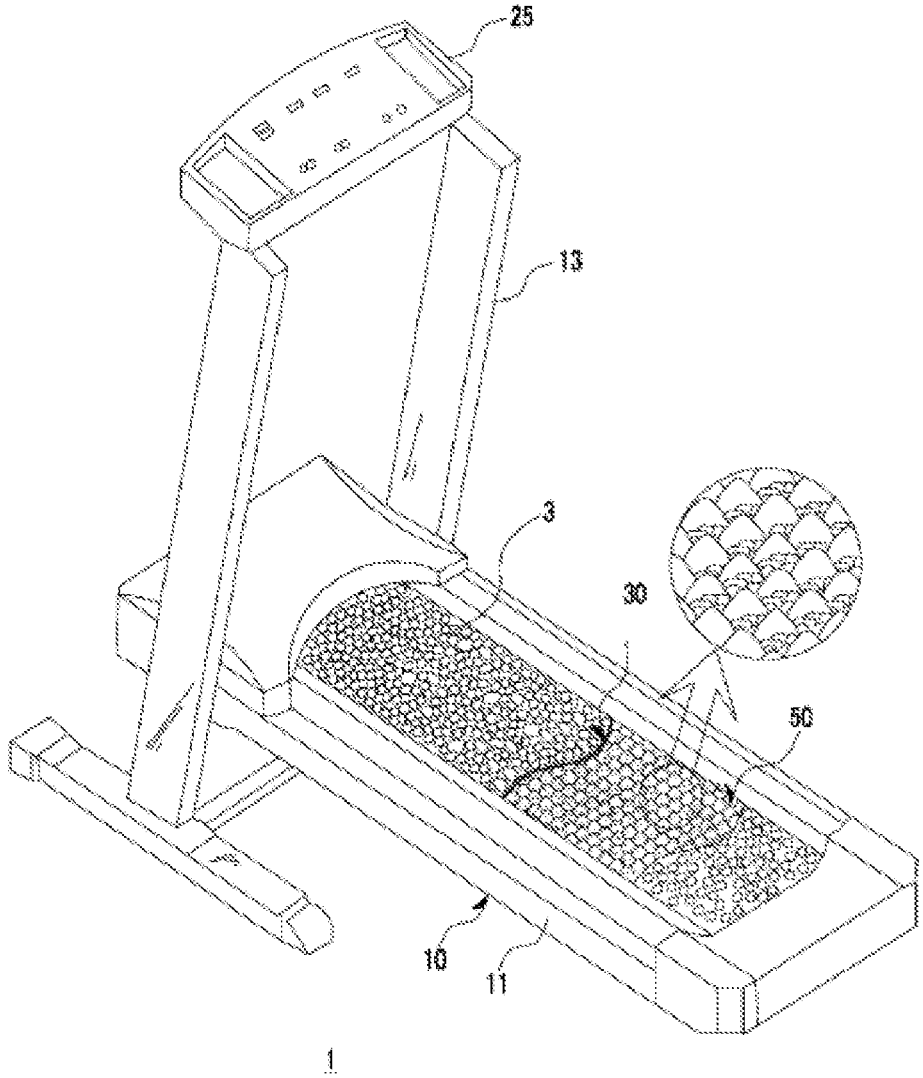

【Fig. 2】
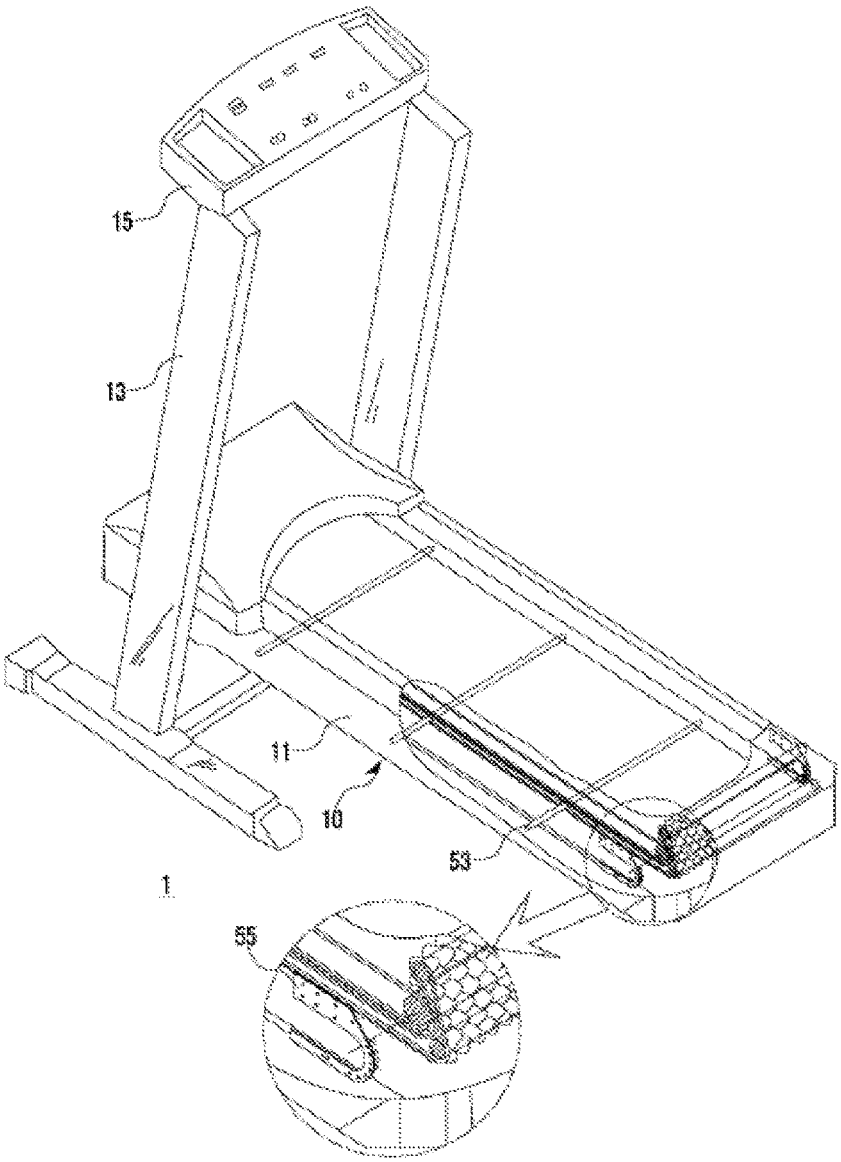

【Fig. 3】
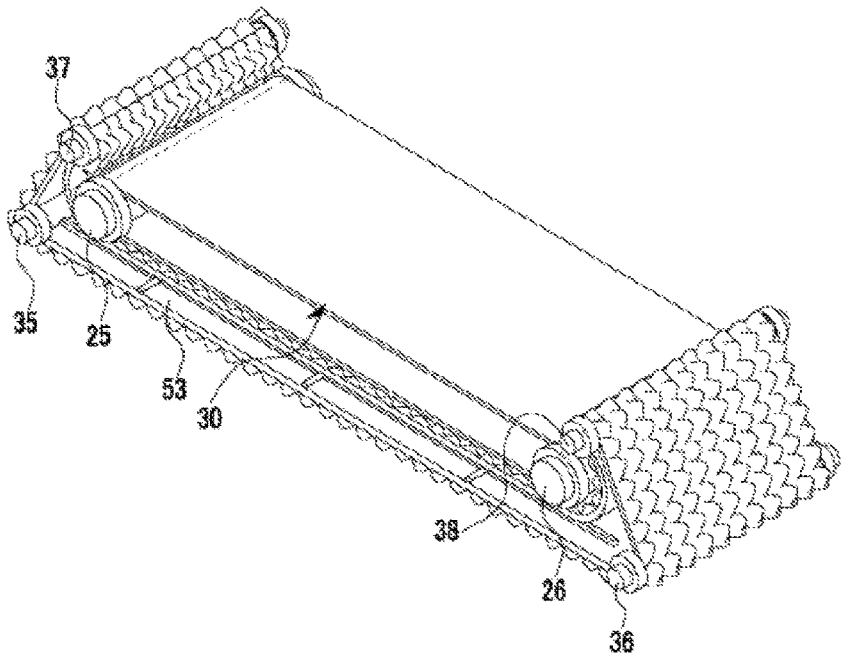
【Fig. 4】
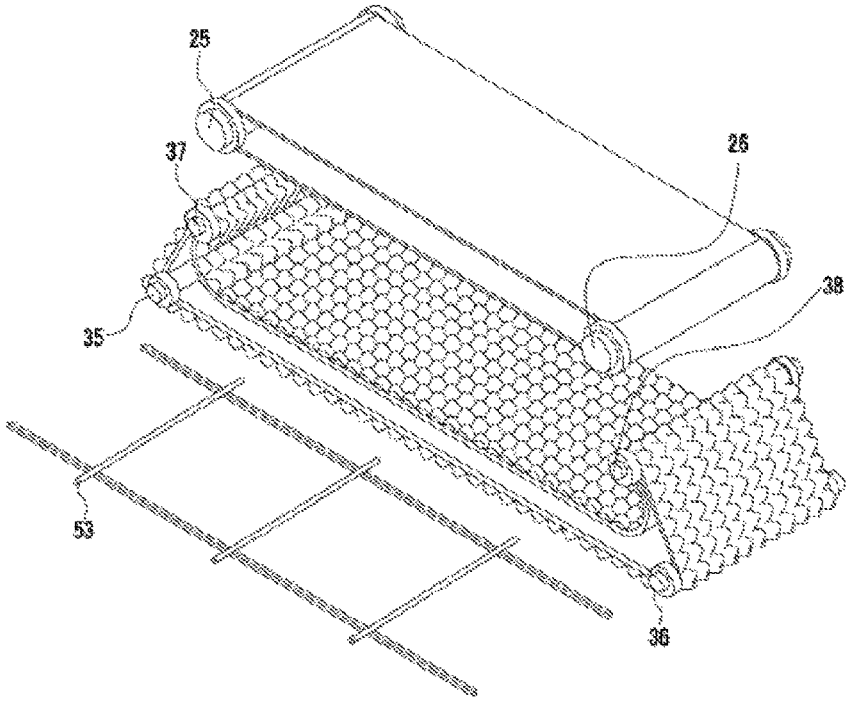

【Fig. 5】
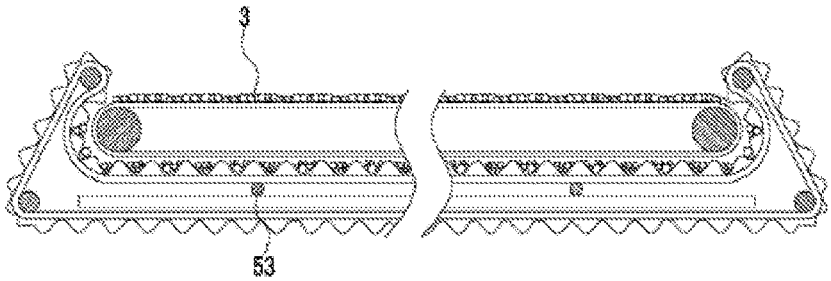
【Fig. 6】
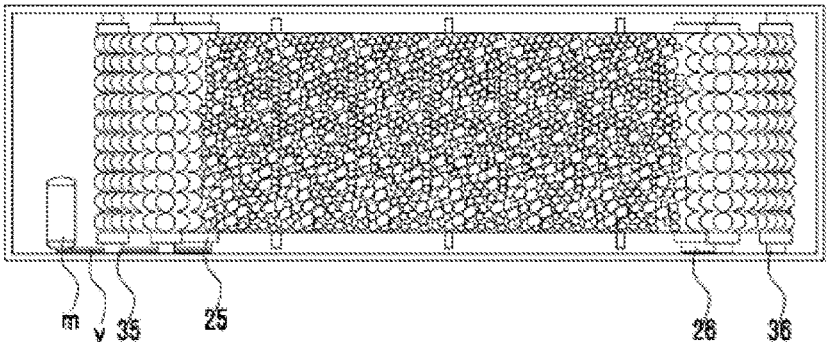
【Fig. 7】
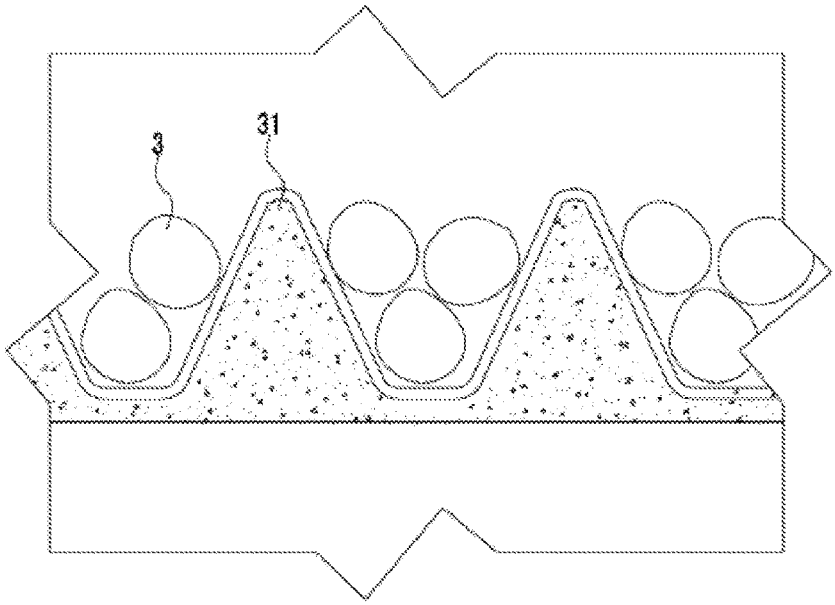

【Fig. 8】
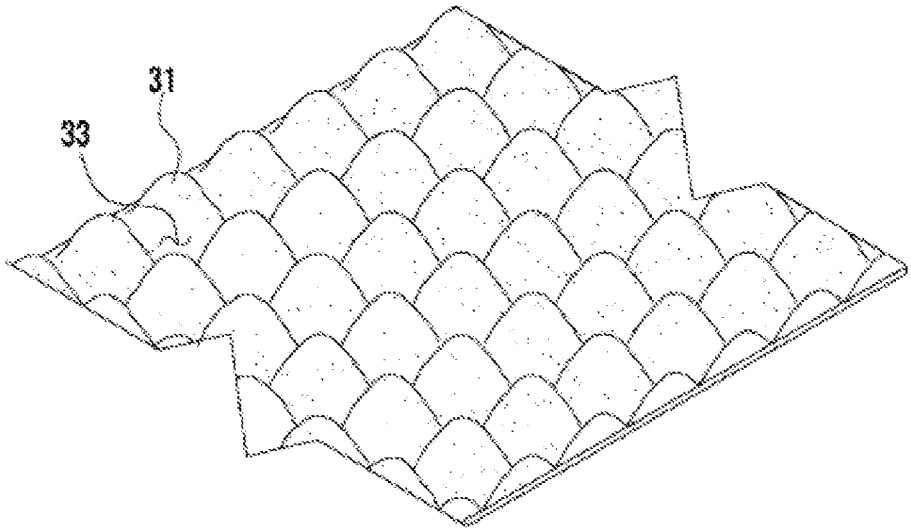

ACUPRESSURE WALKING MACHINE APPLYING PRESSURE TO FOOT REFLEX ZONES

TECHNICAL FIELD

The present invention relates to a treadmill including acupressure stones rotating along a running belt in an infinite orbit and, more particularly, to a treadmill for stimulating foot reflex zones by additionally providing an elastic embossed belt to naturally distribute acupressure stones during rotation, to compensate for excessive friction between the acupressure stones in curved corner periods, thus achieving stable orbital rotation of the acupressure stones.

BACKGROUND ART

In general, a treadmill is aerobic exercise equipment capable of strengthening cardiopulmonary functions and leg muscles of a user, which is configured to allow the user to walk or run in place by rotating a running belt in an infinite orbit and to arbitrarily set an appropriate exercise condition by adjusting a rotation speed and a pitch of the running belt.

Treadmills may be broadly divided into an electric treadmill using an electric motor as a driving source, and a manual treadmill using inclination of a running belt. In the electric treadmill, a driving roller connected to the electric motor to receive driving force therefrom rotates a running belt and thus a user walks or runs at the speed of the running belt. In the manual treadmill, since two freely rotating rollers are mounted at front and rear sides and surrounded by a running belt tilted in such a manner that the front side is positioned higher than the rear side, when a user treads on the running belt, the running belt moves backward due to the weight of the user.

The treadmill has a function of adjusting a rotation speed or a pitch of a running belt to increase the effect of exercise, but does not have any particular effect other than merely running on a flat running belt.

Reflex nerves corresponding to organs of the human body are present in the soles of the feet, which are called reflex zones. About 70% of peripheral nerves are distributed in the hands and the feet. If the reflex zones are stimulated or massaged, fatigue may be relieved due to the reflex principle of peripheral nerves and the blood circulation principle.

As a conventional technology for solving disadvantages of a treadmill, Korean Utility Model Publication No. 1999-0035082 and Korean Utility Model Registration No. 0339175 disclose an acupressure running belt of a treadmill, the acupressure running belt including a plurality of acupressure projections for stimulating the soles of the feet when a user walks or runs on the running belt. In the conventional acupressure running belt, the acupressure projections integrally protrude from and rotate together with the running belt of the treadmill, which rotates using a motor and rotation shafts, and foot reflex zones are stimulated by the acupressure projections configured as convex/concave resin objects integrally provided on the surface of the running belt when a user walks or runs barefoot on the running belt of the treadmill.

However, since the conventional treadmill achieves the acupressure effect merely using the acupressure projections protruding from the surface of the running belt to a certain size, although a relatively light user does not have any problem, a relatively heavy user may feel severe pain or develop plantar fasciitis due to strong pressure of the acupressure projections on the soles of the feet.

To solve the above problem, the present applicant has proposed, in Korean Patent Registration No. 1038381, an improved "running belt acupressure apparatus of a treadmill", in which a running belt is rotatably mounted by providing driving rollers connected to motors at two lower sides of the treadmill, a plurality of natural pebbles are located on the surface of the running belt to integrally rotate together with the running belt, stoppers are provided at two side ends of the running belt to prevent displacement of the natural pebbles, and pressure rollers having a buffer member on the surfaces thereof are mounted above and spaced apart from the driving rollers for rotating the running belt, and are connected to tension rollers and guide rollers using carrier belts mounted to carry the natural pebbles under the running belt.

In the above-described running belt acupressure apparatus of the treadmill, since the natural pebbles may form a layer, move freely, and rotate in an orbit together with the running belt, when a user treads on the natural pebbles, the pebbles naturally move due to the weight of the user. Consequently, excessive contact pressure may not be applied to the soles of the feet of the user and the user may experience the feeling of walking on a natural pebble road.

However, since the carrier belt for rotating the natural pebbles in close contact with a bottom surface of the running belt and a plurality of rollers for supporting the carrier belt are required to rotate the natural pebbles in an orbit, the running belt acupressure apparatus of the treadmill may not be easily manufactured or maintained and may not be produced at low cost due to a complex structure thereof.

To solve the above problem, the present applicant has proposed, in Korean Patent Registration No. 1194018, an "acupressure treadmill" including a body having mounted thereon a cover plate having an open treading window on a top surface thereof, front and rear rollers mounted in the body at front and rear sides, a running belt supported by the rollers to rotate in an infinite orbit, and acupressure stones rotating in an orbit together with the running belt, wherein the running belt includes a belt structure provided in a tube shape having a space filled with the acupressure stones, and including a pair of symmetrical zipper straps capable of spreading a center part of an outer surface of the belt structure to left and right sides, a zipper rail for binding separated parts of the running belt when the zipper straps are closely slid and inserted there into, and provided along the zipper straps to unbind the bound parts on the treading window, and opening guides protruding along edges of the treading window to guide the zipper straps to be separated and spaced apart from each other to expose the acupressure stones filled in the running belt.

However, the acupressure treadmill proposed by the present applicant in Korean Patent Registration No. 1194018 may not be produced or sold at low cost and may not be easily maintained or managed due to a complex structure thereof. Particularly, in all of the registered patents proposed by the present applicant, since acupressure stones such as natural pebbles are exposed all the time, the acupressure stones may be lost during exercise or foreign substances may become lodged between the acupressure stones, thereby causing consumer complaints.

To solve the above problem, the present applicant has proposed, in Korean Patent Registration No. 10-1250893, an "acupressure treadmill" including front and rear rollers mounted in a body at front and rear sides, a running belt supported by the front and rear rollers to rotate in an infinite orbit, and acupressure stones rotating in an orbit together with the running belt, wherein the running belt includes an outer sheet for forming an external surface trod on by a user, an inner sheet provided inside the outer sheet to form an internal surface, belt straps provided between and adhered to two edges of the outer and inner sheets to form a space filled with the acupressure stones between the outer and inner sheets, and a plurality of anti-sag means provided between the outer and inner sheets to suppress sagging due to the acupressure stones during orbital rotation.

However, in Korean Patent Registration No. 10-1250893 proposed by the present applicant, since the acupressure stones are located inside the external sheet, a user treads on the acupressure stones via the external sheet and thus the acupressure effect experienced by the user is greatly reduced.

DISCLOSURE

Technical Problem

Therefore, the present invention has been made in view of the above problems, and it is one object of the present invention to provide a treadmill for stimulating foot reflex zones by exposing acupressure stones trod on by a user and additionally providing an embossed belt rotating together with a running belt to suppress excessive friction between and uniformly distribute the acupressure stones during rotation, to achieve stable orbital rotation of the acupressure stones, and to minimize noise or breakage due to friction between the acupressure stones.

The above and other objects can be accomplished by the present invention described below.

Technical Solution

In accordance with one aspect of the present invention, provided is a treadmill for stimulating foot reflex zones, the treadmill including front and rear rollers mounted in a body at front and rear sides, a running belt supported by the front and rear rollers to rotate in an infinite orbit, and acupressure stones rotating in an orbit together with the running belt, the treadmill further including first and second rollers mounted at sides of the front and rear rollers, and an embossed belt supported by the first and second rollers to rotate in an infinite orbit, provided under the running belt to closely contact the running belt on a top surface thereof, including a plurality of recesses for accommodating the acupressure stones therein, and made of an intumescent material having elasticity.

One of the front and rear rollers and one of the first and second rollers may be connected to and driven by a driving motor to rotate the running belt and the embossed belt in opposite directions.

Third and fourth rollers may be rotatably mounted in the body at upper sides of the front and rear rollers, respectively, and the embossed belt may have front and rear ends rotatably supported by the third and fourth rollers via the first and second rollers.

The body may include a plurality of anti-sag rollers provided in a width direction and rotatably mounted between top and bottom surfaces of the embossed belt with respect to the first and second rollers to prevent sagging of the top surface of the embossed belt.

The embossed belt may be made of an intumescent synthetic resin having elastic restoring force and including protrusions and recesses having a triangular wave shape, a hemispherical shape, or a polygonal shape.

The acupressure stones may include one or more selected from natural pebbles, red clay, germanium, elvan, natural jade, and charcoal.

Advantageous Effects

As apparent from the fore-going, in a treadmill for stimulating foot reflex zones, according to the present invention, by additionally providing an embossed belt made of an elastic material and rotating in an infinite orbit, under a running belt rotating in an infinite orbit, excessive friction between acupressure stones in curved rotation periods may be suppressed to uniformly spread the acupressure stones and thus the acupressure stones provided on the running belt may be uniformly distributed, thereby increasing customer satisfaction. That is, since the embossed belt is made of an elastic material, the acupressure stones may be buffered by and accommodated in recesses and thus excessive stress applied to the acupressure stones may be compensated for. As such, breakage of the acupressure stones may be prevented and noise caused when the acupressure stones collide with each other may be minimized.

Furthermore, when a user treads on the acupressure stones provided on the running belt, since the acupressure stones to which the weight of the user is applied are naturally distributed, excessive pressure locally applied to the soles of the feet of the user may be prevented and thus the acupressure effect may be achieved for a long time without causing pain or displeasure.

In addition, the acupressure stones filled in the running belt may be replaced with not only natural pebbles but also artificial pebbles including red clay, germanium, elvan, natural jade, or charcoal components, or ceramic balls, thereby increasing customer satisfaction.

Features and advantages of the present invention will be more apparent from the following detailed description with reference to the attached drawings. Terms or words used in the specification and claims should not be construed as having normal and lexical meanings, but should be construed as having meanings and concepts corresponding to the technical idea of the present invention based on the principle that an inventor may discretionarily define the concepts of the terms to best explain his/her invention.

DESCRIPTION OF DRAWINGS

The above and other objects, features and other advantages of the present invention will be more clearly understood from the following detailed description taken in conjunction with the accompanying drawings, in which:

FIG. 1 is a perspective view showing the overall appearance of a treadmill for stimulating foot reflex zones, according to the present invention;

FIG. 2 is a partially-cutaway perspective view for describing the internal configuration of the treadmill for stimulating foot reflex zones, according to the present invention;

FIG. 3 is a perspective view of a main part of the treadmill for stimulating foot reflex zones, according to the present invention;

FIG. 4 is an exploded perspective view of the main part of the treadmill for stimulating foot reflex zones, according to the present invention;

FIG. 5 is a side view for describing the configurations of a running belt and an embossed belt of the treadmill for stimulating foot reflex zones, according to the present invention;

FIG. 6 is a top view of the embossed belt of the treadmill for stimulating foot reflex zones, according to the present invention;

FIG. 7 is a magnified cross-sectional view of a part of the embossed belt of the treadmill for stimulating foot reflex zones, according to the present invention; and FIG. 8 is a magnified perspective view of a part of the embossed belt of the treadmill for stimulating foot reflex zones, according to the present invention.

EXPLANATION OF REFERENCE NUMERALS DESIGNATING THE MAJOR ELEMENTS OF THE DRAWINGS

1: Treadmill for stimulating foot reflex zones
10: Body
25,26: Front and rear rollers
30: Running belt
35,36,37,38: First, second, third, and fourth rollers
50: Embossed belt
31: Protrusions
33: Recesses
53: Anti-sag rollers
55: Support brackets
m: Driving motor
v: Belt pulleys

MODE OF THE INVENTION

Hereinafter, the present invention will be described in detail by explaining embodiments of the invention with reference to the attached drawings. Like reference numerals in the drawings denote like elements. In the following description of the present invention, a detailed description of known functions and configurations incorporated herein will be omitted when it may make the subject matter of the present invention unclear.

FIG. 1 is a perspective view showing the overall appearance of a treadmill 1 for stimulating foot reflex zones, according to the present invention.

Referring to FIG. 1, the treadmill 1 includes a body 10 for forming an outer appearance and providing a treading space on a top surface thereof to allow a user to walk or run thereon, a running belt 30 provided on the treading space of the body 10 to rotate in an infinite orbit, and including a plurality of acupressure stones 3 provided on an outer circumferential surface thereof, and an embossed belt 50 provided in the body 10 under the running belt 30 to rotate in an infinite orbit by a driving source and to carry the acupressure stones 3.

FIG. 2 is a partially-cutaway perspective view for describing the internal configuration of the treadmill 1 for stimulating foot reflex zones, according to the present invention.

Referring to FIG. 2, the treadmill 1 includes the body 10 including a base frame 11 for forming an outer appearance and providing a treading space, the running belt 30 exposed on a top surface of the base frame 11 of the body 10, the embossed belt 50 provided under the running belt 30, anti-sag rollers 53 provided in a width direction to prevent sagging of the embossed belt 50, and support brackets 55 provided under the embossed belt 50 to support the embossed belt 50.

FIG. 3 is a perspective view of a main part of the treadmill 1 for stimulating foot reflex zones, according to the present invention, and FIG. 4 is an exploded perspective view of the main part of the treadmill 1 for stimulating foot reflex zones, according to the present invention.

Referring to FIGS. 3 and 4, the treadmill 1 includes a front roller 25 and a rear roller 26 rotatably mounted in the base frame 11 of the body 10, wherein at least one thereof is connected to and driven by a driving source (not shown) to rotate and the other cooperatively rotates in an idle mode, the running belt 30 rotatably supported by the front and rear rollers 25 and 26 to rotate in an infinite orbit, a first roller 35 and a second roller 36 provided below the front and rear rollers 25 and 26, respectively, a third roller 37 and a fourth roller 38 provided above and spaced apart from the front and rear rollers 25 and 26, respectively, the embossed belt 50 rotatably supported by the first to fourth rollers 35 to 38 to rotate in an infinite orbit, and provided to contact front and rear side surfaces and a bottom surface of the running belt 30 rather than a top surface of the running belt 30, and the anti-sag rollers 53 provided between top and bottom surfaces of the embossed belt 50 in a width direction to prevent sagging of the top surface of the embossed belt 50.

FIG. 5 is a side view for describing the configurations of the running belt 30 and the embossed belt 50 of the treadmill 1 for stimulating foot reflex zones, according to the present invention.

Referring to FIG. 5, the front and rear rollers 25 and 26 are provided at left and right sides, respectively, and the running belt 30 is rotatably supported by the front and rear rollers 25 and 26 to rotate in an infinite orbit. The embossed belt 50 is provided to surround the front and rear side surfaces and the bottom surface of the running belt 30. In this case, the embossed belt 50 is rotatably supported by the third and first rollers 37 and 35 provided above and below the front roller 25 and spaced from each other, and the fourth and second rollers 38 and 36 provided above and below the rear roller 26 and spaced from each other.

FIG. 6 is a top view of the embossed belt 50 of the treadmill 1 for stimulating foot reflex zones, according to the present invention.

Referring to FIG. 6, the front roller 25 of the running belt 30 and the first roller 35 of the embossed belt 50 are connected via belt pulleys v to a driving motor m for receiving electricity from outside and providing driving force. In this case, the running belt 30 and the embossed belt 50 are driven to rotate in opposite directions.

FIG. 7 is a magnified cross-sectional view of a part of the embossed belt 50 of the treadmill 1 for stimulating foot reflex zones, according to the present invention.

Referring to FIG. 7, the embossed belt 50 includes protrusions 31 protruding in a triangular wave shape, and recesses 33 connected to the protrusions 31 and sunken in a triangular wave shape to accommodate the acupressure stones 3 therein.

FIG. 8 is a magnified perspective view of a part of the embossed belt 50 of the treadmill 1 for stimulating foot reflex zones, according to the present invention.

Referring to FIG. 8, the embossed belt 50 has an uneven structure including a plurality of protrusions 31 protruding in a convex shape, and a plurality of recesses sunken in a concave shape between the protrusions 31. The present invention proposes that the embossed belt 50 is made of an intumescent synthetic resin having elasticity.

The configuration of the treadmill 1 for stimulating foot reflex zones, according to the present invention, will now be described with reference to the above-described drawings.

The treadmill 1 for stimulating foot reflex zones, according to the present invention, broadly includes the body 10 for forming an outer appearance, the front and rear rollers 25 and 26 rotatably mounted in the body 10 at front and rear sides, the running belt 30 provided to surround the front and rear rollers 25 and 26 and to rotate in an infinite orbit, and the embossed belt 50 provided under the running belt 30 to rotate in a direction opposite to the running belt 30 and to carry the acupressure stones 3 together with the running belt 30.

The body 10 includes the base frame 11 having a rectangular shape and providing a treading space to allow a user to walk or run thereon, a pair of vertical frames 13 vertically provided at two front sides of the base frame 11, and a manipulation panel 15 provided on top of the vertical frames 13 to be manipulated by the user or to display an operational status of the treadmill 1.

The base frame 11 is provided in a rectangular shape having a size sufficient to allow the user to walk or run thereon. A top surface of the base frame 11 is open. Although not shown in the drawings, a plurality of height-adjustable feet or wheels for smooth movement may be provided on a bottom surface of the base frame 11.

The vertical frames 13 are lengthwise elements almost vertically provided at two front sides of the base frame 11, and the manipulation panel 15 to be described below is mounted on the vertical frames 13. Although not shown in the drawings, handles to be held by the hands of the user may be provided on the vertical frames 13.

The manipulation panel 15 may be configured as a keypad including buttons or switches to allow the user to adjust a driving speed or a pitch of the running belt 30, or a display for displaying an operational status of the treadmill 1.

The above-described body 10 may also operate similarly to a well-known treadmill, and thus a detailed description thereof is not provided herein.

In the body 10 according to the present invention, the anti-sag rollers 53 are rotatably mounted in a width direction between top and bottom surfaces of the embossed belt 50 to be described below with respect to the first and second rollers 35 and 36 to be described below to prevent sagging of the top surface of the embossed belt 50. The above-described anti-sag rollers 53 are provided in plural number at intervals along a length direction of the embossed belt 50.

The front and rear rollers 25 and 26 are rotatably mounted in the base frame 11 at front and rear sides, respectively. That is, the front roller 25 is rotatably supported by a bearing (not shown) at a front side with respect to the vertical frames 13 of the body 10, and the rear roller 26 is spaced apart from the front roller 25 and is also rotatably mounted by a bearing at a rear side of the front roller 25.

The above-described front and rear rollers 25 and 26 may be rotated by a driving source. In the present invention, the front roller 25 may be connected to and rotated by the driving motor m for receiving electricity and generating rotational driving force, and the rear roller 26 may be freely rotated. The driving motor m and the front roller 25 may be interconnected using chains, belts, or gears. In the present invention, for example, the driving motor m and the front roller 25 are interconnected using the belt pulleys v.

The above-described structure for driving the front and rear rollers 25 and 26 may also be implemented using well-known technology, and the type, number, and locations of rollers may be variously changed as long as the rollers rotate the running belt 30 to be described below.

The running belt 30 is an element capable of providing a treading space to the user and carrying the acupressure stones 3, and is rotatably supported by the front and rear rollers 25 and 26 to rotate in an infinite orbit. The above-described running belt 30 may use a running belt applied to a well-known treadmill, and thus a detailed description thereof is not provided herein.

The acupressure stones 3 provided on the outer circumferential surface of the running belt 30 have a size and a hardness level sufficient to stimulate the soles of the feet of the user when the user treads thereon, and may use not only natural pebbles but also artificial pebbles including red clay, germanium, elvan, natural jade, or charcoal components, or ceramic balls.

The embossed belt 50 has main technical features of the present invention, and is an element provided under the running belt 30 and closely contacting the running belt 30 on a top surface thereof to carry the acupressure stones 3.

The above-described embossed belt 50 is an element having an embossed structure including the recesses 33 for accommodating the acupressure stones 3 therein. As illustrated in the drawings, the protrusions 31 and the recesses 33 are regularly repeated. Although the present invention proposes the protrusions 31 and the recesses 33 having a triangular wave shape, the protrusions 31 and the recesses 33 may have a hemispherical or polygonal convex/concave shape.

In addition, the embossed belt 50 is made of an intumescent synthetic resin having buffering properties and elastic restoring force in order to suppress breakage or noise due to friction between the acupressure stones 3 when the acupressure stones 3 are carried.

The embossed belt 50 has a structure supported by a plurality of rollers to rotate in an infinite orbit. To this end, the present invention proposes the first to fourth rollers 35 to 38. That is, the first and second rollers 35 and 36 are rotatably mounted in the body 10 at lower sides of the front and rear rollers 25 and 26, respectively, which rotatably support the running belt 30, and the third and fourth rollers 37 and 38 are rotatably mounted in the body 10 at upper sides of the front and rear rollers 25 and 26, respectively.

Herein, one of the first to fourth rollers 35 to 38 serves as a driving roller connected to the driving motor m to receive rotational driving force. In the present invention, for example, the first roller 35 is connected via the belt pulleys v to and driven by the driving motor m to rotate. That is, any one of the front and rear rollers 25 and 26 and any one of the first and second rollers 35 and 36 are connected to the driving motor m to rotate the running belt 30 and the embossed belt 50 in opposite directions. The present invention proposes that the front roller 25 and the first roller 35 are connected via the belt pulleys v to the driving motor m to rotate in opposite directions.

The embossed belt 50 is supported by the support brackets 55 fixed to two lower side edges of front and rear ends of the body 10. The above-described support brackets 55 serve as supporters for ultimately preventing sagging of the embossed belt 50 and the running belt 30 located on the embossed belt 50.

Operation of the above-described treadmill 1 for stimulating foot reflex zones, according to the present invention, will now be described.

When the user applies electricity to the driving motor m by manipulating a switch provided on the manipulation panel 15, the front roller 25 and the first roller 35 connected to the driving motor m are driven to rotate in opposite directions, and thus the running belt 30 provided to surround the front and rear rollers 25 and 26 rotates in an infinite orbit.

Due to rotation of the first roller 35, the embossed belt 50 provided to surround the second to fourth rollers 36 to 38 also rotates in an infinite orbit.

In this case, since the acupressure stones 3 having various sizes and shapes are provided on the outer circumferential surface of the running belt 30, the user may naturally walk or run at a low speed on the acupressure stones 3 as the running belt 30 moves.

The acupressure stones 3 provided on the outer circumferential surface of the running belt 30 are moved from the front roller 25 toward the rear roller 26 and then between a rear end of the running belt 30 and a rear end of the embossed belt 50 provided to partially surround the rear end of the running belt 30.

In this case, since the embossed belt 50 includes the protrusions 31 and the recesses 33, the acupressure stones 3 are naturally accommodated and carried in the recesses 33 of the embossed belt 50. In this process, the acupressure stones 3 partially overlapping each other when trod on by the user are uniformly distributed when inserted into the recesses 33 of the embossed belt 50. That is, the acupressure stones 3 located between a bottom surface of the running belt 30 and a top surface of the embossed belt 50 are moved while being accommodated in the recesses 33 of the embossed belt 50, and ultimately rotate toward an upper front side of the running belt 30.

While the present invention has been particularly shown and described with reference to embodiments thereof, it will be understood by one of ordinary skill in the art that various changes in form and details may be made therein without departing from the spirit and scope of the present invention as defined by the following claims.

The invention claimed is:

1. A treadmill for stimulating foot reflex zones, the treadmill comprising:

front and rear rollers mounted in a body at front and rear sides;

a running belt supported by the front and rear rollers to rotate in an infinite orbit; and acupressure stones rotating in an orbit together with the running belt, the treadmill further comprising:

first and second rollers mounted at sides of the front and rear rollers; and an embossed belt supported by the first and second rollers to rotate in an infinite orbit, provided under the running belt to closely contact the running belt on a top surface thereof, comprising a plurality of recesses for accommodating the acupressure stones therein, and made of an intumescent material having elasticity.

2. The treadmill according to claim 1, wherein one of the front and rear rollers and one of the first and second rollers are connected to and driven by a driving motor to rotate the running belt and the embossed belt in opposite directions.

3. The treadmill according to claim 1, wherein third and fourth rollers are rotatably mounted in the body at upper sides of the front and rear rollers, respectively, and wherein the embossed belt has front and rear ends rotatably supported by the third and fourth rollers via the first and second rollers, and is made of an intumescent synthetic resin having elastic restoring force and comprising protrusions and recesses having a triangular wave shape, a hemispherical shape, or a polygonal shape.

4. The treadmill according to claim 1, wherein the body comprises a plurality of anti-sag rollers provided in a width direction and rotatably mounted between top and bottom surfaces of the embossed belt with respect to the first and second rollers to prevent sagging of the top surface of the embossed belt.

5. The treadmill according to claim 1, wherein the acupressure stones comprise one or more selected from natural pebbles, red clay, germanium, elvan, natural jade, and charcoal.

* * * * *